US006077115A

United States Patent [19]

Yang et al.

[11] Patent Number: 6,077,115

[45] Date of Patent: Jun. 20, 2000

[54] ELECTRICAL CONNECTOR

[75] Inventors: Johnson Yang, Tai-Shan; Kun-Tsan Wu, Tu-Chen, both of Taiwan

[73] Assignee: Hon Hai Precision Ind. Co., Ltd., Taipei Hsien, Taiwan

[21] Appl. No.: 09/315,890

[22] Filed: May 20, 1999

[51] Int. Cl.[7] ..... H01R 13/73

[52] U.S. Cl. ..... 439/567; 439/607

[58] Field of Search ..... 439/567, 571–573, 439/357, 607, 358, 608–610

[56] References Cited

U.S. PATENT DOCUMENTS 5,178,557 1/1993 Hashiguchi ..... 439/570
5,603,639 2/1997 Lai et al. ..... 439/353
5,820,393 10/1998 Edgley et al. ..... 439/567

*Primary Examiner*—Gary F. Paumen
*Attorney, Agent, or Firm*—Wei Te Chung

[57] ABSTRACT

An electrical connector includes an insulative housing having a central section defining a plurality of passageways therein for receiving contact elements and two end sections. Two latching members have a U-shaped structure fit over the end sections. Each latching member has a latching arm extending from a bottom wall of the U-shaped structure thereof for engaging with a mating connector. Each latching member has a board lock integrally formed therewith. The board lock includes two spaced resilient legs extending from a side wall of the U-shaped structure for engaging with a hole defined in a circuit board to mount the connector thereto.

14 Claims, 8 Drawing Sheets

ELECTRICAL CONNECTOR

BACKGROUND OF THE INVENTION

1. Field of the Invention

The present invention generally relates to an electrical connector.

2. The Prior Art

Electrical connectors of the type disclosed in U.S. Pat. No. 5,178,557 are well known in the electronics field. As shown in FIG. 8 of the attached drawings, the '557 connector generally comprises an insulative housing 71 having a base section 72 and two end blocks 74. Each end block 74 defines a bore 75 for receiving a locking block 73 which has a latching arm 76 extending beyond a front face 78 of the housing 71 for engaging with a mating connector (not shown). The locking block 73 defines an inner-threaded hole 70 for receiving and engaging with a bolt (not shown) for securing the connector to a circuit board (not shown). The locking block 73 and the latching arm 76 are integrally formed by means of plastic molding whereby the hook 76 has a poor mechanical strength and may be easily broken. Furthermore, the connector is secured to the circuit board by means of bolts whereby the assembly thereof is laborious and time consuming.

U.S. Pat. No. 5,603,639 discloses an electrical connector wherein the latch is made of metal which overcomes the mechanical deficiency problem of the '557 patent. However, the '639 connector is still secured to a circuit board by means of bolts thereby hindering the assembly process for mounting the connector to the circuit board.

It is thus desirable to provide an electrical connector that is readily mounted to a circuit board.

SUMMARY OF THE INVENTION

Accordingly, an object of the present invention is to provide an electrical connector that is readily mounted to a circuit board.

Another object of the present invention is to provide an electrical connector comprising a latching member made from a metal plate for engaging with a mating connector, a board lock being integrally formed with the latching member for securing the connector to a circuit board.

A further object of the present invention is to provide an electrical connector wherein a board lock and a latching member are integrated together for simplifying the structure of the connector.

To achieve the above objects, an electrical connector in accordance with the present invention comprises an insulative housing having a central section defining a plurality of passageways therein for receiving contact elements and two end sections. Two latching members have a U-shaped structure fit over the end sections. Each latching member comprises a latching arm extending from a bottom wall of the U-shaped structure thereof for engaging with a mating connector. Each latching member comprises a board lock integrally formed therewith. The board lock includes two spaced resilient legs extending from a side wall of the U-shaped structure for engaging with a hole defined in a circuit board to mount the connector thereto.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
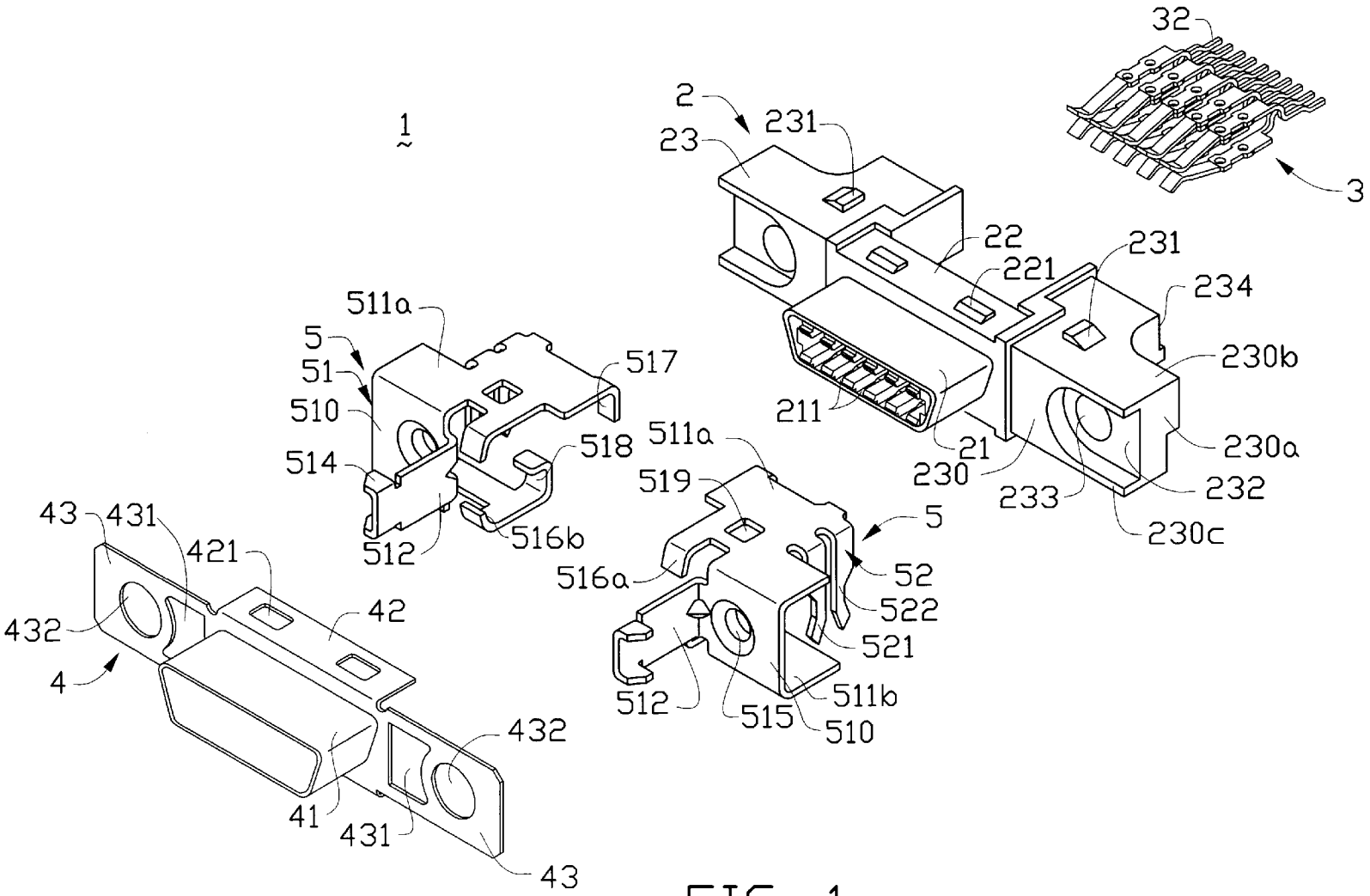
FIG. 1 is an exploded view of an electrical connector in accordance with the present invention.
Figure 2:
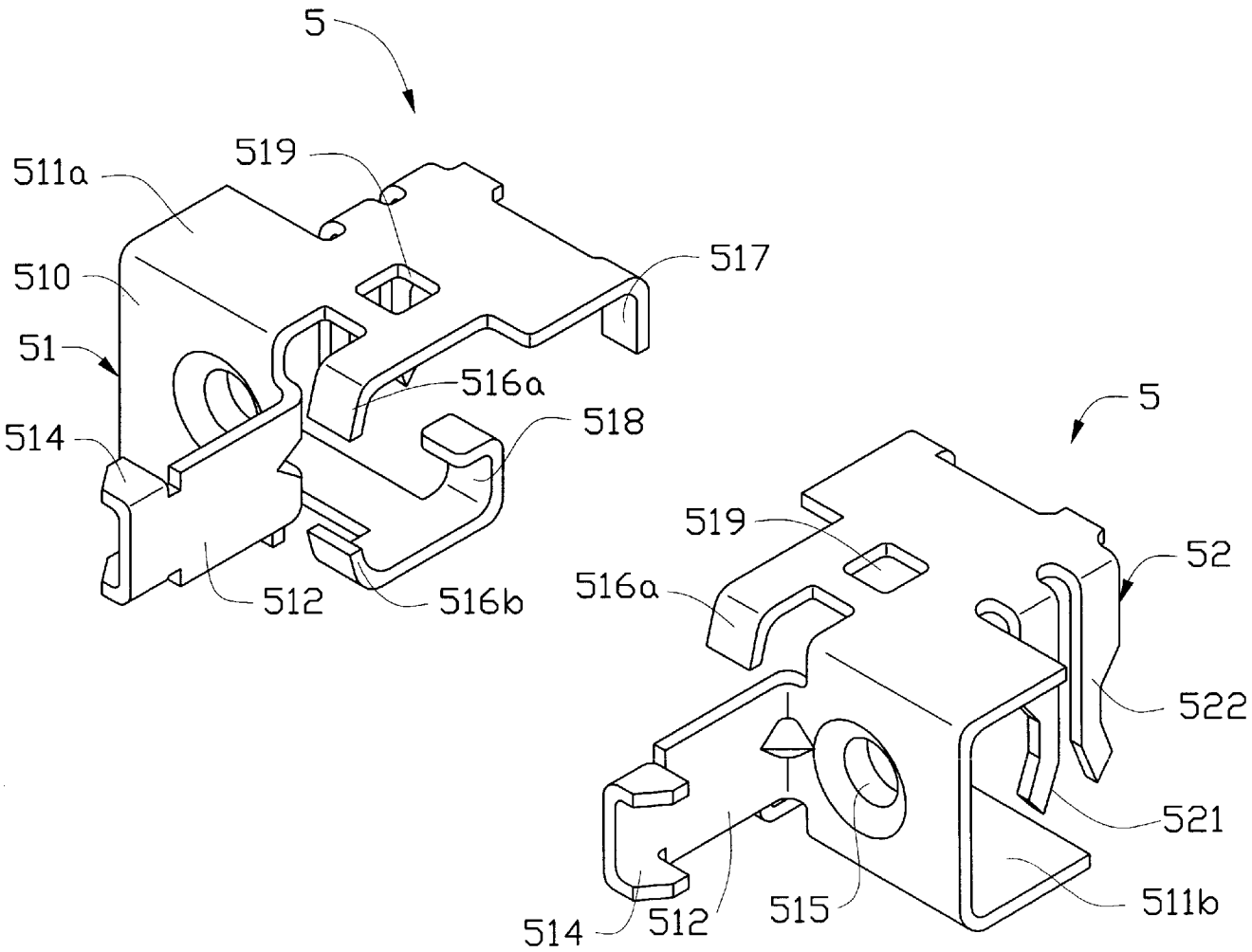
FIG. 2 is a perspective view of latching members of the electrical connector of the present invention.
Figure 3:
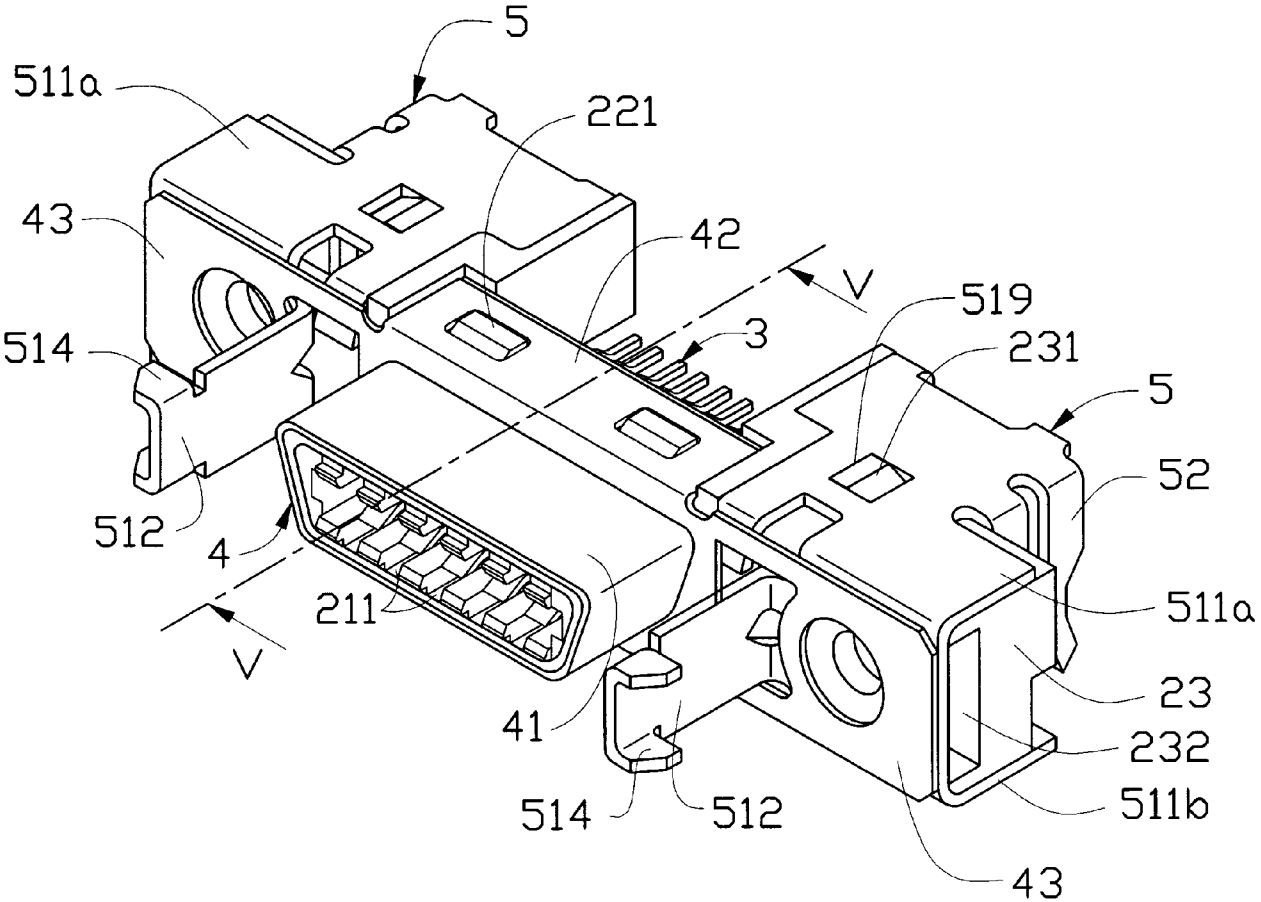
FIG. 3 is an assembled view of FIG. 1.

Referring to the drawings and in particular to FIGS. 1 and 3, an electrical connector 1 constructed in accordance with the present invention comprises an insulative housing 2 having a central section 22 and two end sections 23. Two latching members 5 are respectively mounted to the end sections 23 of the housing 2. As particularly shown in FIG. 2, each latching member 5 has a U-shaped structure 51 comprising a bottom wall 510 and two opposite side walls 511*a*, 511*b* fit over the corresponding end section 23 of the housing 2 in a sideways direction with the bottom wall 510 and the side walls 511*a*, 511*b* respectively abutting against a front face 230 and top and bottom faces 230*b*, 230*c* of the end section 23. The side wall 511*a* of each latching member 5 defines an opening 519 engaging with a barb 231 formed on a top face 230*b* of the corresponding end section 23 for retaining the latching member 5 thereon. A latching arm 512 extends from the bottom wall 510 of each latching member 5 and forms end barbs 514 for engaging with and retaining a mating connector (not shown).

The central section 22 has a mating portion 21 extending therefrom. A shielding member 4 has a central tubular projection 41 fit over the mating portion 21 and two side tabs 43 corresponding to the end sections 23 for interposing the bottom walls 510 of the latching members 5 therebetween whereby the latching arms 512 of the latching members 5 extend through slots 431 defined in the side tabs 43. The central section 22 of the housing 2 comprises barbs 221 formed on top and bottom faces (not labeled) thereof for engaging with openings 421 defined in top and bottom extensions 42 of the shielding member 4 thereby securing the shielding member 4 to the housing 2.

Each side tab 43 of the shielding member 4 defines a hole 432 and the bottom wall 510 of each latching member 5 defines a hole 515 corresponding thereto. The holes 432, 515 of the shielding member 4 and the latching member 5 are aligned with each other and with a bore 233 defined in the corresponding end section 23 of the housing 2 for receiving a fastener (not shown) to secure them together.

The housing 2 defines a plurality of channels 211 through both the mating portion 21 and the central section 22 for receiving and retaining contact elements 3 therein.

Each side wall 511*a*, 511*b* of each latching member 5 further comprises a rear flange 517, 518 for engaging with a rear face 234 of the corresponding end section 23 of the housing 2 for securely retaining the latching member 5 on the end section 23. The rear flange 518 is J-shaped and received in a slot 237 (FIG. 4) defined in the end section 23.

Preferably, each side wall 511*a*, 511*b* of the latching member 5 further comprises a front flange 516*a*, 516*b* engaging with the front face 230 of the corresponding end section 23 of the housing 2.

A board lock 52 comprises a pair of resilient legs 522 integrally formed with and extending from the side wall 511*a* of each latching member 5. The resilient legs 522 are spaced from each other and have expanded free ends 521 formed by outward bending and adapted for insertion into a hole (not labeled) defined in a circuit board 9 (FIG. 5) for mounting the connector 1 to the circuit board 9 and electrically connecting the tail ends 32 of the contact elements 3 to the circuit board 9.

The latching members 5 may be made from a single metal plate with the board lock 52 integrally formed therewith thereby simplifying the structure and the assembly of the connector 1 and also simplifying the process of mounting the connector 1 to the circuit board since bolts are not required.

The hole 515 of the bottom wall 510 of each latching member 5 may also be formed by a metal forming process whereby a cylindrical extension is formed projecting from a periphery of the hole 515. To accommodate the extension of the hole 515, a recess 232 is defined in each end section 23 of the housing. The recess 232 is exposed to the front face 230 and also a side face 230*a* of the end section 23 for facilitating insertion of the extension of the hole 515 therein.

Figure 4:
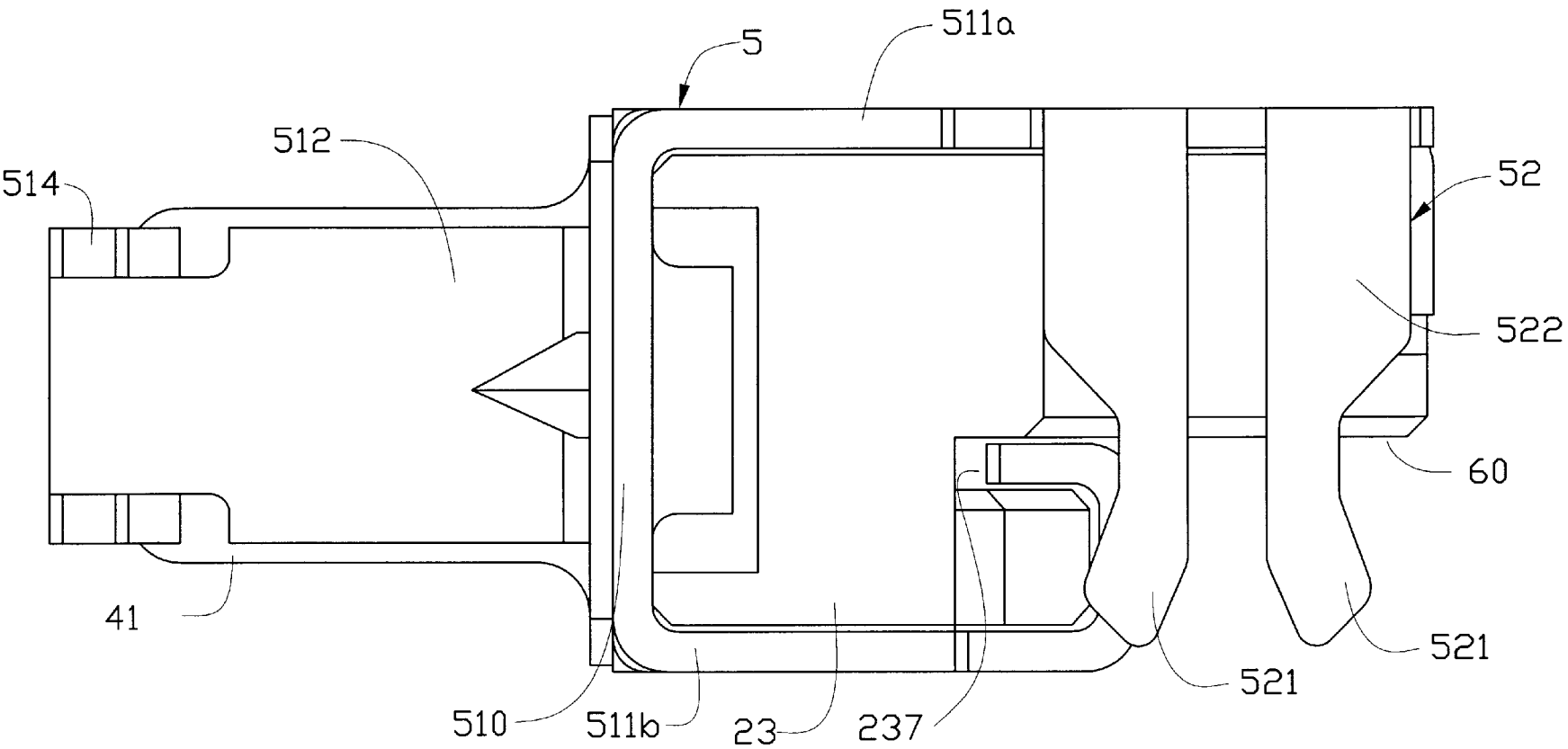
FIG. 4 is a side elevational view of the electrical connector of FIG. 3.
Figure 5:
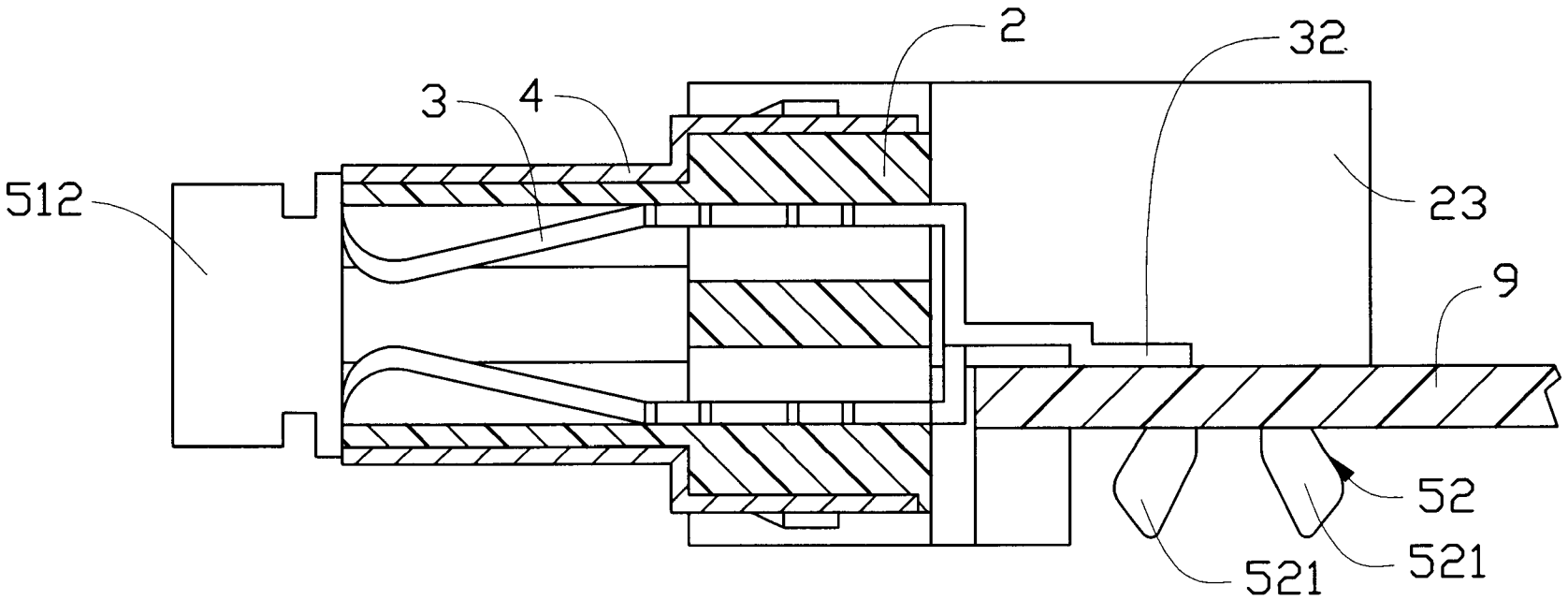
FIG. 5 is a cross-sectional view taken along line V—V of FIG. 3.

As shown in FIGS. 4 and 5, each end section 23 of the housing 2 has a support face 60 for supporting the connector 1 on the circuit board 9. The support face 60 may be distanced from the bottom face 230*c* of the end section 23 and located midway between the bottom face 230*c* and the top face 230*b* of the end section 23 thereby reducing the height of the connector above the circuit board 5. However, it is apparent that the support face 60 may be coplanar with the bottom face 230*c* of the end section 23, if desired.

Figure 6:
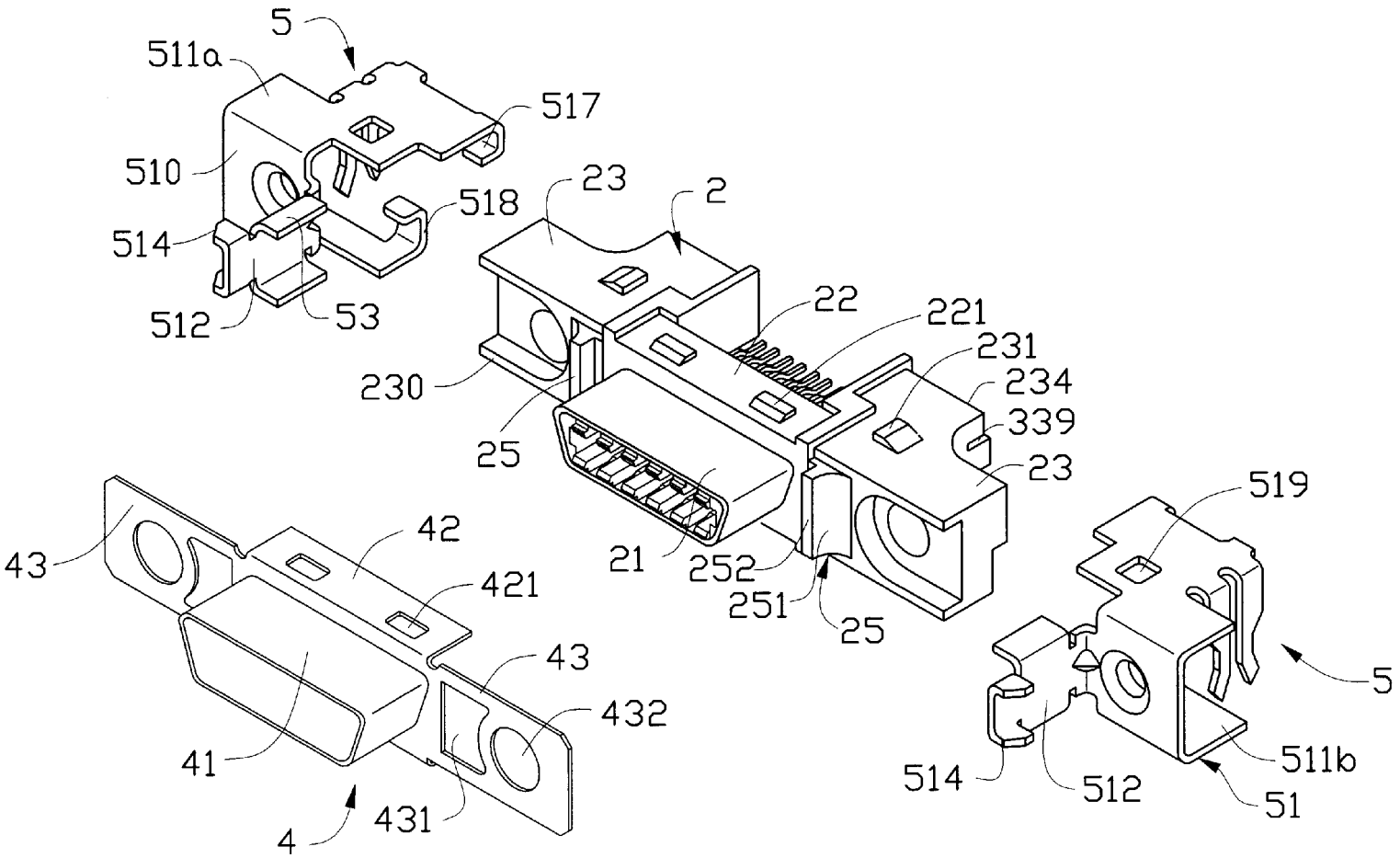
FIG. 6 is an exploded view of an electrical connector constructed in accordance with a second embodiment of the present invention.
Figure 7:
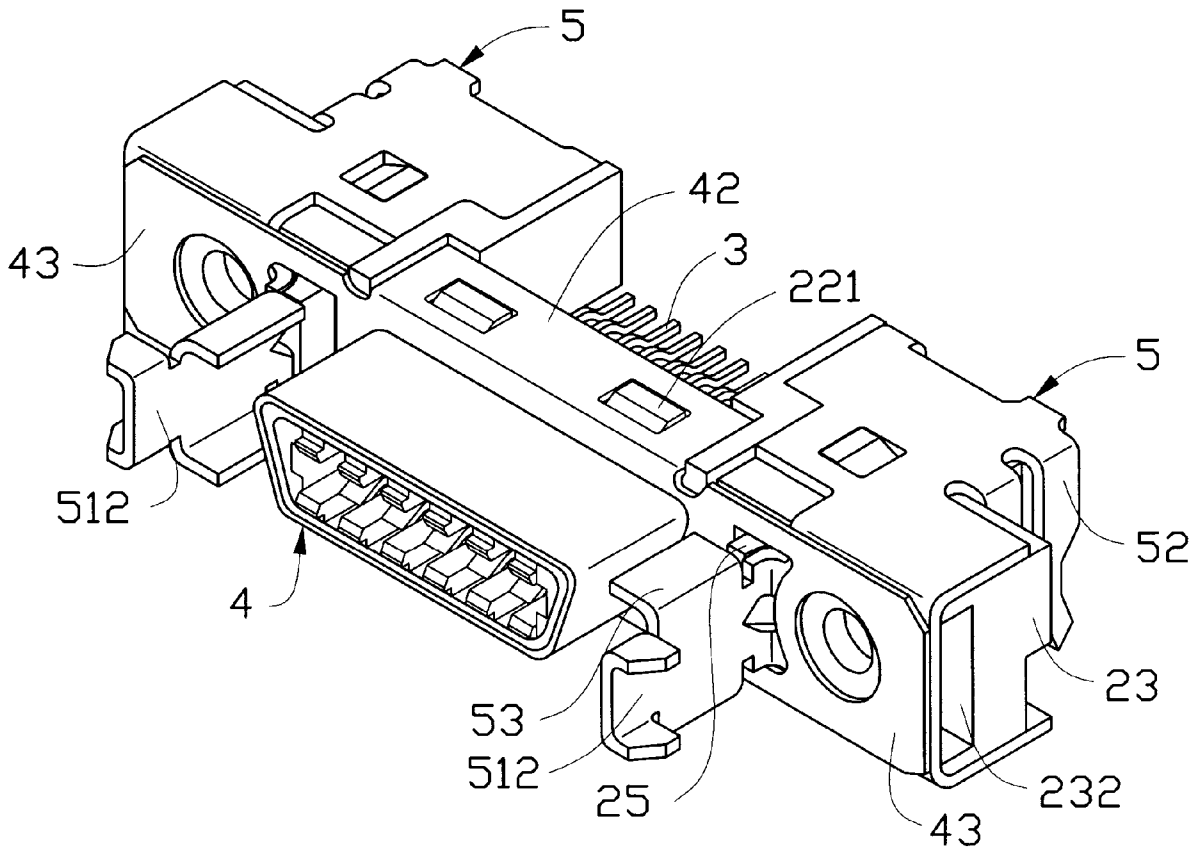
FIG. 7 is an assembled view of the electrical connector of FIG. 6.
Figure 8:
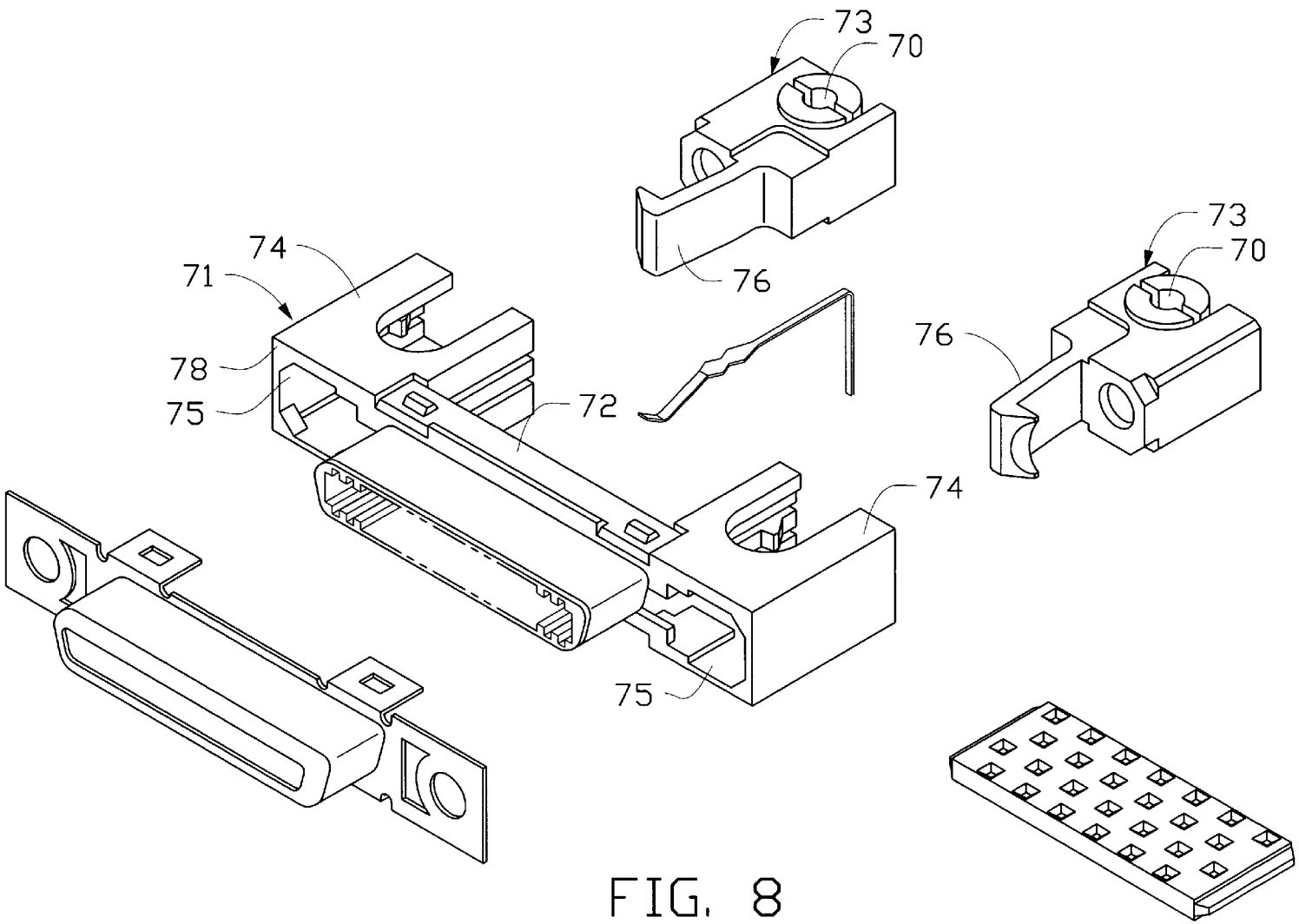
FIG. 8 PRIOR ART
FIG. 8 is an exploded view of a prior art connector.

In FIGS. 6 and 7, a second embodiment of the present invention is generally similar to the first embodiment except that a supporting projection 25 is formed on the front face 230 of each end section 23 of the housing 2. The supporting projection 25 has a face 251 in surface contact with the latching arm 512 of the corresponding latching member 5 for supporting the latching arm 512 during engagement with the mating connector. The latching arm 512 may be provided with flanges 53 for engaging a free end 252 of the supporting projection 25 thereby firmly supporting the latching arm 512. It is apparent that, if desired, the face 251 of the supporting projection 25 does not need to contact the latching arm 512 since the engagement between the flanges 53 of the latching arm 512 and the end 252 of the supporting projection 25 provides sufficient support of the latching arm 512.

The face 251 of the supporting projection 25 may comprise an arcuate section for accommodating an arcuate portion between the latching arm 512 and the bottom wall 510 of the U-shaped structure 51 of the latching member 5 resulting from the metal forming process.

Furthermore, the rear flange 517 of each latching member 5 may also be formed to be J-shaped and received in a slot 339 defined in the rear face 234 of the corresponding end section 23 of the housing 2.

The remaining parts of the second embodiment are identical to those of the first embodiment and thus a detailed description is not required Although the present invention has been described with reference to preferred embodiments, it is apparent to those skilled in the art that a variety of modifications and changes may be made without departing from the scope of the present invention which is intended to be defined by the appended claims.

What is claimed is:

1. An electrical connector adapted to be mounted to a circuit board, comprising an insulative housing having a central section defining a plurality of passageways therein for receiving contact elements in electrical engagement with the circuit board and two end sections, and two latching members each having a U-shaped structure fit over the corresponding end section, a latching arm extending from a bottom wall of the U-shaped structure for engaging with a mating connector, the improvements comprising a board lock having two spaced resilient legs integrally formed with and extending from a side wall of the U-shaped structure and adapted to engage with a hole defined in the circuit board to mount the connector thereto.

2. The electrical connector as claimed in claim 1, wherein the resilient legs have expanded ends.

3. The electrical connector as claimed in claim 2, wherein the expanded ends are formed by bending each resilient leg outward.

4. The electrical connector as claimed in claim 1, wherein each end section of the housing comprises a projection having a face in contact engagement with the latching arm of the corresponding latching member for supporting the latching arm.

5. The electrical connector as claimed in claim 4, wherein each latching arm comprises flanges engaging with an end of the corresponding projection for providing increased support thereto.

6. The electrical connector as claimed in claim 1, wherein the latching member is made from a single metal plate and defines a hole in the bottom wall thereof forming a cylindrical extension projecting from a periphery thereof, and wherein a recess is defined in each end section and exposed to a front face thereof for accommodating the cylindrical extension, the recess being further exposed to a side face of the end section for facilitating insertion of the extension therein.

7. The electrical connector as claimed in claim 6, wherein the end section defines a bore therein corresponding to the hole of the latching member, a shielding member being attached to the central section with side tabs thereof abutting against the bottom walls of the latching members, each side tab defining a hole corresponding to the hole of the latching member, the bore of the end section of the housing and the holes of the latching member and the shielding member being aligned with each other and adapted to receive a fastener therethrough for securing the shielding member and the latching member to the corresponding end section of the housing.

8. The electrical connector as claimed in claim 1, wherein the bottom wall of the latching member abuts against a front face of the end section, the latching member further having two side walls respectively abutting against top and bottom faces of the end sections, each side wall having a first flange engaging with a rear face of the end section.

9. The electrical connector as claimed in claim 8, wherein at least one of the first flanges is J-shaped and received in a slot defined in the end section.

10. The electrical connector as claimed in claim 9, wherein each side wall of the latching member has a J-shaped second flange received in a slot defined in the end section of the housing.

11. The electrical connector as claimed in claim 8, wherein each side wall further comprises a third flange engaging with the front face of the end section.

12. The electrical connector as claimed in claim 8, wherein each side wall of the latching member defines an opening for engaging with a barb formed on the corresponding end section of the housing.

13. The electrical connector as claimed in claim 1, wherein each end section has a support face distanced from a bottom face thereof and adapted to be positioned on the circuit board to support the connector thereon.

14. An electrical connector comprising an insulative housing defining two end sections at two opposite ends, a latching member being disposed unto each of said end sections, said latching member defining a U-shaped structure including an upper side wall, a lower side wall and a bottom wall therebetween, a latching arm extending perpendicularly from the bottom wall of said U-shaped structure, said upper side wall and said lower side wall further including flanges for guidable engagement with the connector, a board lock integrally formed with one of said upper side wall and said lower side wall, and lying in a plane parallel to said latching arm.

* * * * *